United States Patent [19]

Novis

[11] Patent Number: 4,538,877

[45] **Date of Patent: * Sep. 3, 1985**

[54] ELECTRICAL BRIDGING CONNECTOR WITH POST SEPARATOR HOUSING

[76] Inventor: Joseph R. Novis, 3798 Kensington Dr., Marietta, Ga. 30066

[ * ] Notice: The portion of the term of this patent subsequent to Nov. 20, 2001 has been disclaimed.

[21] Appl. No.: 491,206

[22] Filed: May 3, 1983

Related U.S. Application Data

[63] Continuation-in-part of Ser. No. 337,578, Jan. 7, 1982, Pat. No. 4,483,577.

[51] Int. Cl.[3] ..... H01R 13/50

[52] U.S. Cl. ..... 339/156 R

[58] Field of Search ..... 29/859, 855, 868; 339/17 F, 65, 66 R, 66 M, 66 T, 91 R, 154 R, 156 R, 159 M, 176 MP, 204, 205, 206 R, 206 P, 208, 217 S

[56] References Cited

U.S. PATENT DOCUMENTS

| | | | |
|---|---|---|---|
| 3,035,244 | 5/1962 | Aveni | 339/156 |
| 3,359,533 | 12/1967 | Barry | 339/217 |
| 3,364,458 | 1/1968 | Black, Jr. et al. | 339/258 |
| 3,383,648 | 5/1968 | Tems | 339/258 |
| 3,529,279 | 9/1970 | Logue et al. | 339/176 |
| 3,663,922 | 5/1972 | Foust, Jr. . | |
| 3,740,697 | 6/1973 | Van Son | 339/103 M |
| 3,745,515 | 7/1973 | Michaels . | |
| 3,747,050 | 7/1973 | Hecht | 339/156 A |
| 3,850,499 | 11/1974 | Bauerle et al. | 339/156 R |
| 3,854,788 | 12/1974 | Goodman | 339/176 M |
| 3,894,784 | 6/1975 | Clewes | 339/156 R |

OTHER PUBLICATIONS

Document captioned, "Price Sheet: OEM-282" (front only of one page).

Document entitled, "Bridgeklip-2 Bridging System" (front and reverse of one page).

*Primary Examiner*—Howard N. Goldberg
*Assistant Examiner*—Carl J. Arbes
*Attorney, Agent, or Firm*—Kilpatrick & Cody

[57] ABSTRACT

An electrically conductive bridging connector to permit stacking electronic jacks which have wire-wrap posts disposed in pairs forming a double row and corresponding pin receiving receptacles. The connector has an electrically nonconductive body with a housing having housing walls, a blade member and tooth members forming an "egg crate" structure to separate the wire-wrap posts and has spring contacts to make electrical contact with the posts on one jack and corresponding pins to be received by a second jack. A nonconductive bridging insulator of similar construction permits temporary stacking of jacks while electrical connection is made to a new jack. Methods of utilizing the bridging insulator and the bridging connector are also disclosed to facilitate retermination of cable connecting to electronic equipment such as remreed line-link or trunk-link network electronic switching system telephone equipment.

5 Claims, 7 Drawing Figures

ELECTRICAL BRIDGING CONNECTOR WITH POST SEPARATOR HOUSING

BACKGROUND OF THE INVENTION

This is a continuation-in-part of my application for U.S. Letters Patent having Ser. No. 337,578 and filed in the U.S. Patent Office on Jan. 7, 1982 now U.S. Pat. No. 4,483,577 issued 11/20/1984. This invention relates to an electrical bridging connector similar to the electrical bridging connector disclosed in my above-referenced patent application. The connector is utilized to permit convenient and reliable electrical connection of a jack to wire-wrap posts, which posts are typically on a like jack previously wired and in use.

The electrical bridging connector of the present invention is particularly well adapted for use with Western Electric 963K1 jacks which connect to Western Electric remreed line-link or trunk-link network No. 1 and No. 1A electronic switching system telephone equipment.

The Western Electric 963K1 jack is similar in appearance and function to the Western Electric 951A jack described in my above-referenced patent application, and is used to connect multiple conductor cables to the above-described equipment. One such jack connects to up to thirty-two conduction pins on such equipment. For a variety of reasons, particularly including the need to expand or alter service, telephone company users of such equipment frequently need to connect additional or substitute cables to the above-described equipment after the original 963K1 jack is wired and installed. Such recabling is typically done by wrapping the wire conductors of the new cables on the wire-wrap posts of the existing 963K1 jack and later cutting the old, first connected cables out of the system, thereby disconnecting them from the 963K1 jack.

Alternatively, in the prior art practice, splices are made directly onto existing cable conductors, in accordance with a practice known as a "half-tap" or "Y-splice" of the cable. Both methods of connecting new cables to the existing equipment make it difficult to identify and repair electrical problems experienced in the system, are difficult to accomplish, frequently result in loss of service of all or a portion of the system for undesirably long periods, and require large amounts of labor, particularly when virtually simultaneous disconnection of various cables must occur during service interruptions to permit switching from an old cable system to a newly installed one.

SUMMARY OF THE INVENTION

Recabling may be accomplished more easily and with fewer problems by use of the present invention. Such recabling is generally accomplished by mounting the nonconducting bridging insulator of the present invention on the existing 963K1 jack installed in the remreed network at the point where connection of the new cable is desired, and a new 963K1 jack is mounted on the back of the bridging insulator. Then, without interrupting existing service or risking introduction of a short circuit resulting from contact between adjacent wire-wrap posts of the existing 963K1 jack, the new cable can be fanned and formed accurately and connected to the new 963K1 jack because the new jack is positioned in or very close to the location in which it will ultimately be used. Then, the bridging insulator may be removed and the bridging connector of the present invention may be plugged into the back of the new 963K1 jack to permit electrical verification of correct connection of the new cable to the new jack by testing through the bridging connector. Thereafter, at a convenient time, typically when there is minimum telephone or other traffic on the circuits, the new jack may be electrically connected to the remreed network by removing the old 963K1 jack from the network, stacking it on the back of the bridging connector, and plugging the new 963K1 jack into the network.

At a subsequent time, the old jack and the bridging connector may be removed without interrupting service, and the old cable may thereafter be removed or "mined" and thereby recovered whenever convenient.

Alternately, the old 963K1 jack can be left connected to the network and the new jack may be electrically connected to the old one by means of an intermediate bridging connector of the present invention, thus electrically stacking the new jack on top of the old one.

It is therefore an object of the present invention to provide a nonconducting bridging insulator or connector for temporarily mounting jacks in or adjacent to the physical location in which they will ultimately be utilized to facilitate attachment of cable leads to such jacks.

It is another object of the present invention to provide a method of connecting new telephone cables to existing telephone equipment which minimizes service interruption, reduces the likelihood that wiring errors will occur and facilitates "mining" or removal of old cable after the new cable is placed in service.

It is yet another object of the present invention to provide a conducting bridging connector to permit "stacking" of wire-wrap jacks to permit parallel electrical connection of such jacks.

DETAILED DESCRIPTION OF THE DRAWINGS

Figure 1:
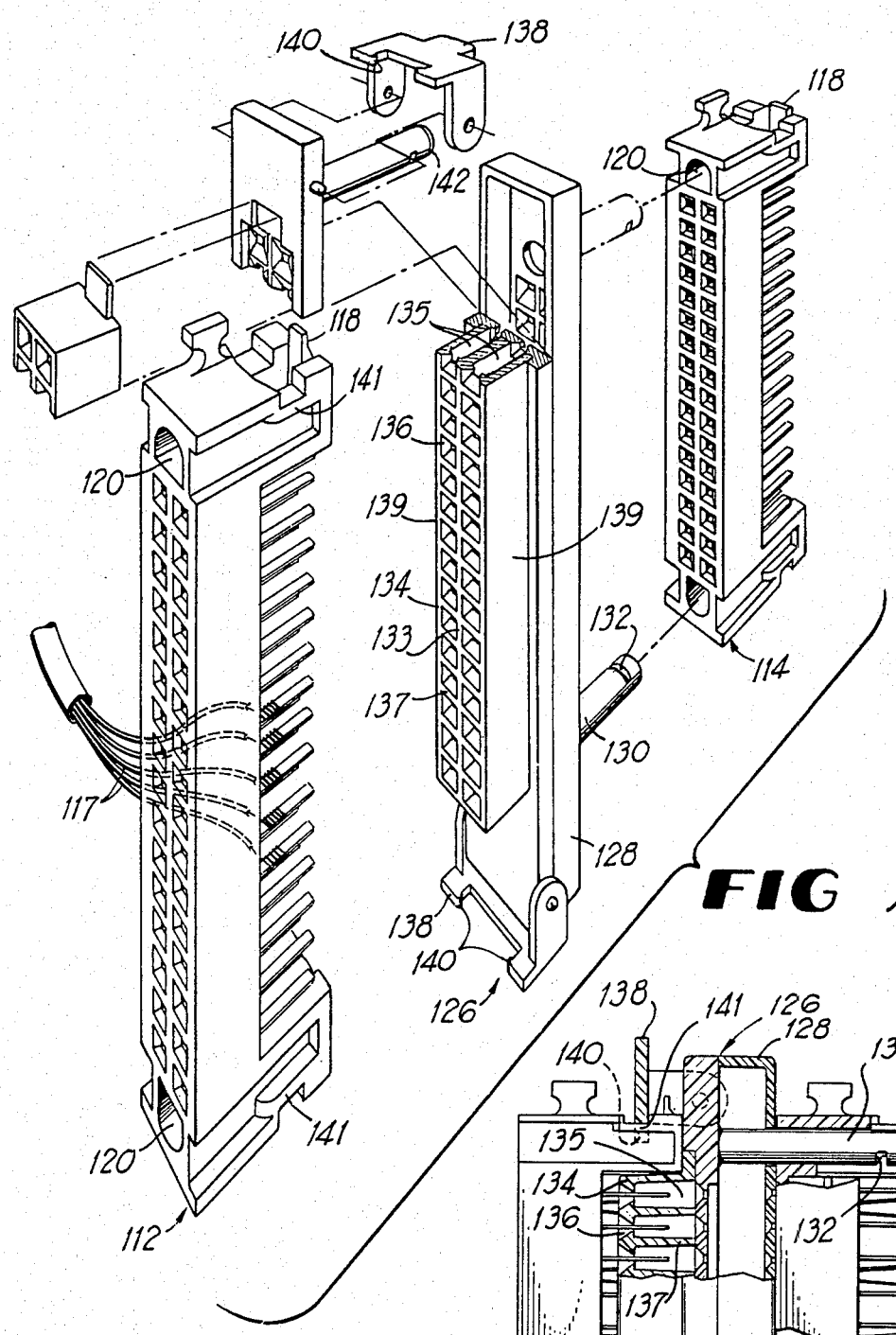
FIG. 1 is an exploded perspective view of one embodiment of a bridging insulator of the present invention, shown in relation to an existing Western Electric 963K1 jack and a new like jack.

In the figures, jacks 112 and 114 are electrical jacks having pairs of wire-wrap posts 116 forming a double row of posts for connection of cable leads 117, which are typically wrapped on the posts 116 close to the jack 112 body, thus leaving the ends of posts 116 bare. The jacks 112 and 114 illustrated are Western Electric model 963K1 jacks normally used with Western Electric remreed line-link or trunk-link network No. 1A or No. 1 electronic switching system telephone equipment.

Each 963K1 jack 112 and 114 has a tangent 118 visible FIGS. 1–7 which extends partially into a bore 120 in either end of the jack 112 or 114. Tangent 118 is biased to extend into bore 120, but may be pivoted out of bore 120 by pressure exerted toward jack 112 on tangent 118 to permit bores 120 of jack 112 to receive the metal studs (not shown) on the remreed telephone switching equipment. Tangent 118 then engages an annular depression or slot in such studs to lock jack 112 in place on the remreed switching equipment.

The nonconducting bridging insulator of the present invention is indicated generally by numeral 126 in FIG. 1. Bridging insulator 126 comprises generally a body 128, studs 130 having slots 132, a post separator housing 134 and an attaching means such as rotatable clamps 138. Body 128 is a box shaped structure approximately as long and wide as jack 112 and of a convenient thickness, such as approximately one-half inch or thirteen millimeters. Post separator housing 134 is also a generally box shaped structure which is mounted on body 128. Post separator housing 134 comprises a longitudinal blade member 133 positioned between two housing walls 139 with tooth members 137 normal to and between each side of blade member 133 and housing walls 139 to form an "egg crate" structure in which blade member 133 separates rows of wire-wrap posts 116 and tooth members 137 separate adjacent pairs of wire-wrap posts 116 when insulator 126 is mounted on jack 112. Blade member 133, tooth members 137 and walls 139 form and define chambers 135, visible in FIG. 2, each of which chambers 135 receives a wire wrap post 116. The edges of blade member 133, tooth members 137 and walls 139 facing away from body 128 are shaped to form indented openings 136. Indented openings 136 are aligned with chambers 135 and guide wire-wrap posts 116 into chambers 135 as insulator 126 is being mounted.

Figure 2:
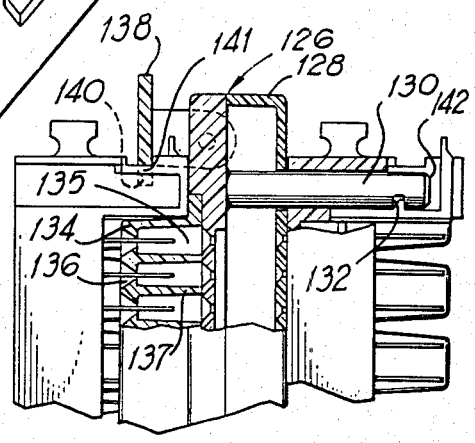
FIG. 2 is a partial section/side elevational view of the insulator of FIG. 1.
Figure 3:
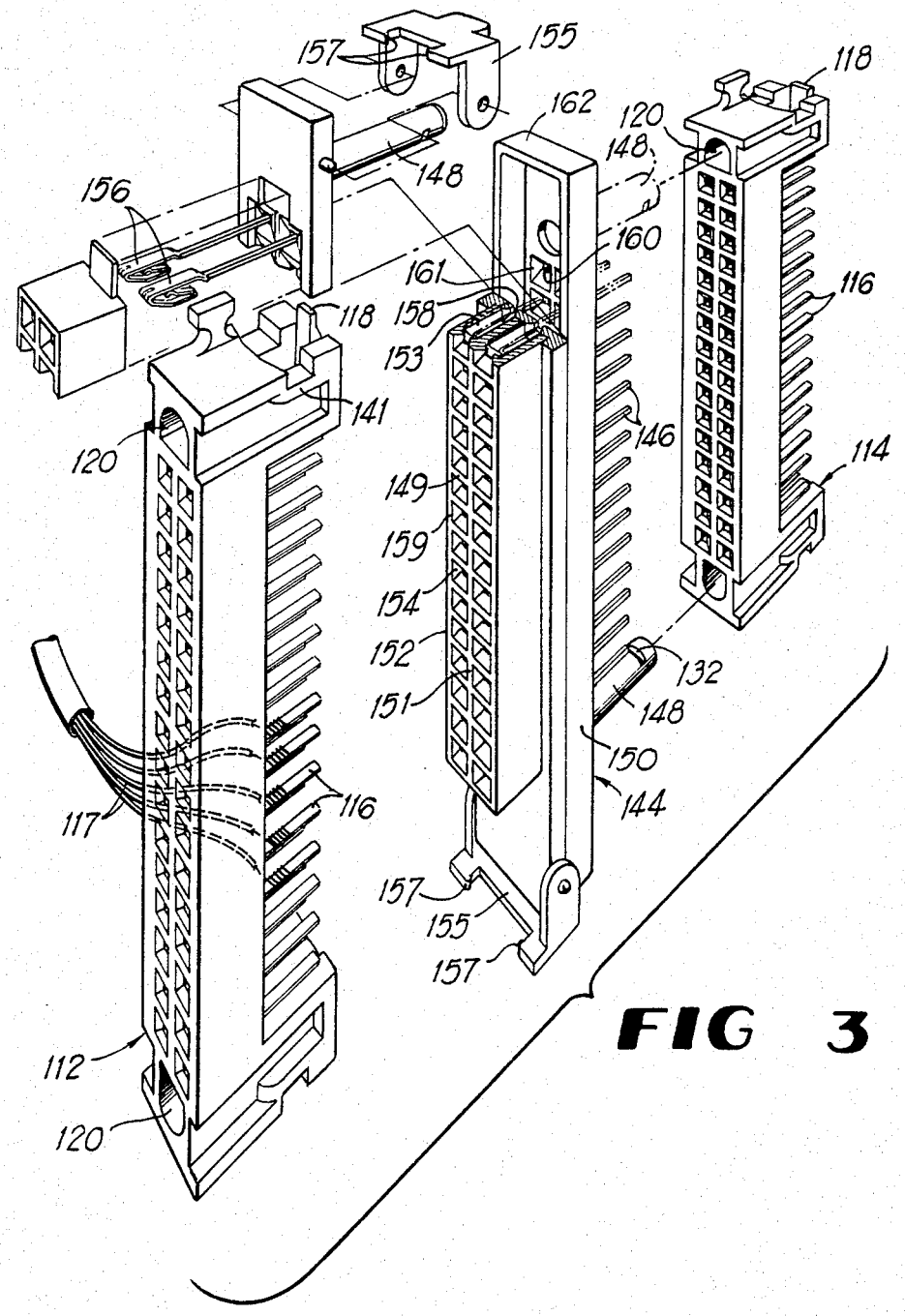
FIG. 3 is an exploded perspective view of one embodiment of a bridging connector of the present invention, shown in relation to an existing Western Electric 963K1 jack and a new like jack.

Slots 132 in studs 130 are formed by removing or omitting segments of studs 130 corresponding to the location of tangent 118 in jack 114 when jack 114 is mounted on insulator 126, and studs 130 have chamfered ends 142 as shown on FIG. 2. Rotatable clamp 138 is pivotally mounted to insulator body 128 and has catches 140 which impinge on lip 141 of jack 112 to removably engage and capture jack 112. Accidental removal of jack 112 from the remreed equipment to which it is attached during removal of insulator 126 cannot occur because the ends of housing 134 contact tangents 118 to hold them in place on the studs on which jack 112 is mounted.

Bridging insulator 126 may be molded or machined of any suitable nonconducting material such as polycarbonate plastic.

Bridging insulator 126 is utilized by positioning it so that wire-wrap posts 116 on the existing jack 112 are aligned with openings 136 in housing 134, pressing insulator 126 onto jack 112 and rotating rotatable clamps 140 until they are locked onto lips 141 of jack 112. Rotatable clamps 138 hold bridging insulator 126 in place with respect to jack 112, and housing 134 prevents electrical contact between pairs of wire-wrap posts 116.

A new jack 114 is then mounted on bridging insulator 126 by receiving studs 130 of insulator 126 in bores 120 of jack 114 and forcing the studs 130 into bores 120 until tangents 118 of jack 114 are biased out of bores 120 by the advancing chamfered ends 142 of studs 130. As studs 130 continue to advance into bores 120, tangents 118 seat in slots 132 of studs 130, thereby capturing studs 130 and holding jack 114 in place on insulator 126 until tangents 118 of jack 114 are disengaged by pressure exerted on them as jack 114 is removed.

As will be readily appreciated by one skilled in the art, temporarily mounting new jack 114 by means of nonconducting bridging insulator 126 adjacent to existing jack 112, to which jack 114 will eventually be connected or which jack 114 will replace, permits the leads of the new cable (not shown) to be fanned and formed accurately and to be accurately located and cut to length. It similarly will be appreciated that the "egg crate" structure of housing 134 and openings 136 and chambers 135 therein will simultaneously diminish the likelihood that a short circuit resulting from contact between wire-wrap posts 116 of old jack 112 will be inadvertently created while wiring of jack 114 is being accomplished.

After the new cable leads have been connected to wire-wrap posts 116 of jack 114, and, if desired, pair verification or other electrical testing has been accomplished, jack 114 may be electrically connected to the electronic equipment with which it is used by one of at least three alternative procedures. First, if continued electrical connection of jack 112 is no longer desired, jack 114 may be removed from bridging insulator 126, jack 112 removed from the equipment to which it is connected, and jack 114 connected directly to such equipment. Second, if continued temporary or permanent electrical connection of jack 112 is desired, the above-described procedure may undertaken and then followed by the additional steps of mounting bridging connector 144, shown in FIGS. 3–5, on the wire-wrap posts 116 of jack 114 as is described below and mounting jack 114 on bridging connector 144. Third, where interruption of service to the cable connected to the existing jack 112 must be avoided or other reasons dictate, demounting of new jack 114 from bridging insulator 126 and removal of bridging insulator 126 from existing jack 112 may be followed by the additional steps of mounting new jack 114 on the pins 146 and studs 148 of bridging connector 144 and then mounting bridging connector 144 on the wire-wrap posts 116 of existing jack 112 as is indicated by the exploded view of such connection in FIGS. 3–5.

Bridging connector 144 shown in FIGS. 3–7 comprises generally a body 150 similar in structure to the body 128 of nonconducting bridging insulator 126, having studs 148 with slots 132; a housing 152, with indented openings 154, chambers 153, blade member 151, and teeth members 149; and a rotatable clamp 155. The structure of housing 152 and openings 154 is substantially similar to the structure of housing 134 and openings 136 of bridging insulator 126.

Figure 4:
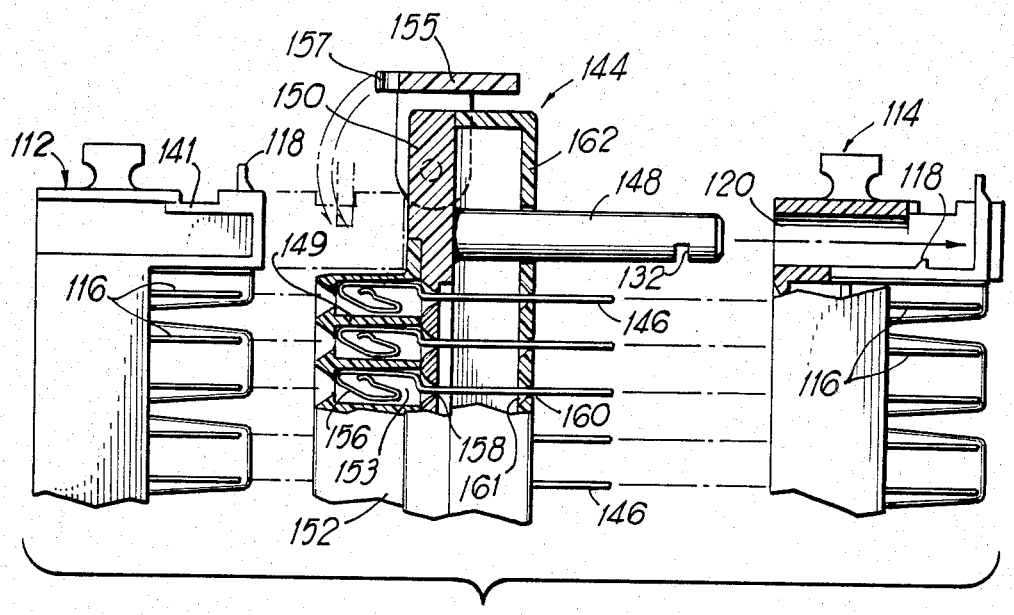
FIG. 4 is a partial section/side elevational view of the connector of FIG. 3.
Figure 5:
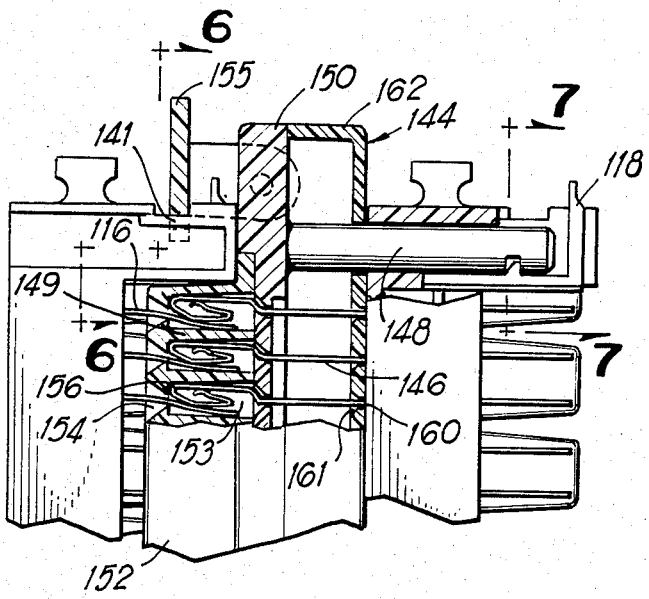
FIG. 5 is a partial section/side elevational view of the connector of FIG. 3 connected to an existing Western Electric 963K1 jack and a new like jack.

Bridging connector 144 also includes contacts 156, visible in FIGS. 4 and 5, which, in the preferred embodiment, are bifurcated bellow spring contacts of phosphor bronze with gold plating over nickel. The tooth members 149 in housing 152, each of which correspond to an opening 154 therein, bear against contacts 156 to support contacts 156 and oppose the tendency for wire-wrap posts 116 to force contacts 156 away from wire-wrap posts 116 and thereby break contacts 156 off of pins 146 to which they connect.

Each contact 156 in connector 144 is disposed such that it bears against a tooth member 149 so as to capture the corresponding wire-wrap post 116 between the contact 156 and the tooth member 149 when connector 144 is mounted on wire-wrap post 116 of a jack 112 or 114. The desired electrical contact is promoted by openings 154 in housing 152 which guide wire-wrap posts 116 between contacts 156 and the corresponding tooth members 149. This will be appreciated by reference to FIGS. 4 and 5 which illustrate alignment of openings 154, tooth members 149, chambers 153 and contacts 156. As will be understood by reference to the discussion of nonconducting bridging insulator 126 above, the tooth members 149, blade member 151, chambers 153 and openings 154 in housing 152 prevent electrical contact between wire-wrap posts 116 of jack 112 and serve to guide each post 116 into contact with the corresponding contact 156 on connector 144 when the connector 144 is mounted on a double row of wire-wrap posts 116.

Figure 6:
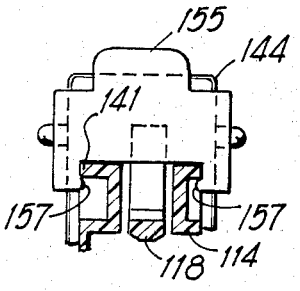
FIG. 6 is a sectional view of the connector of FIG. 5 and the existing Western Electric 963K1 jack to which it is connected, taken along section 6—6 of FIG. 5.

Connector 144 is firmly secured to jack 112 by use of any convenient jack capturing structure such as rotatable clamps 155 having catches 157 which engage and removably capture lips 141 of jack 112 as shown in FIG. 6. In this manner, rotatable clamps 155 hold bridging connector 144 in place with respect to jack 122.

Figure 7:
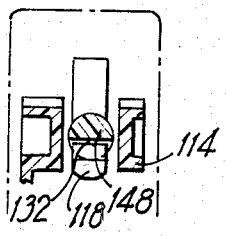
FIG. 7 is a sectional view of the connector of FIG. 5 and the new Western Electric 963K1 jack to which it is connected taken along section 7—7 of FIG. 5.

Contacts 156 in connector 144 terminate in square wire pins 146 which are inserted through pin holes 158 in body 150 and, as may be seen in FIGS. 4 and 5, through second pin holes 160 in pin block 162. Pin holes 158 are located in two rows, corresponding to openings 154 in housing 152, and are aligned with second pin holes 160. As may be seen in FIGS. 4 and 5, a pin hole 160 may taper to a larger opening 161 on the side of pin block 162 facing body 150 to facilitate assembly of connector 144 by guiding pins 146 into second pin holes 160. Pin block 162 serves accurately to align and support pins 146 so they will be properly located for insertion in the pin receiving contactors or receptacles 164 (not shown) of jack 114. Jack 114 is guided onto pins 146 by studs 148 which are received in bores 120 of jack 114, and it is held in place by frictional contact between the pin receiving contactors 164 and pins 146 and engagement of slots 132 by tangents 118 of jack 114 as shown in FIGS. 5 and 7. Connector body 150, pin block 162 and contact 156/pin 146 units may be assembled by use of any appropriate adhesive such as cyanoacrylate adhesive.

Bridging connector 144 thus provides secure physical mounting for new jack 114 immediately behind existing jack 112 and provides electrical connection between each wire-wrap post 116 of jack 112 and the corresponding wire-wrap post 116 of new jack 114.

Although pins 146 are shown connected directly to contacts 156 in the embodiment of connector 144 illustrated in FIGS. 4 and 5, a manual or electronic switching structure or circuit may also be incorporated in connector 144 to permit interruption of electrical connection between pins 146 and the corresponding contacts 156. A connector 144 incorporating such a switch may be utilized with the switch in the "off" position in place of insulator 126 described above during wiring of jack 114. Electrical connection of jack 114 to jack 112 can then be accomplished simply by actuating the switch to complete electrical contact between pins 146 and contacts 156. Such a switchable connector 144 also permits switching jack 144 in and out of the circuitry without physical removal of jack 144. A mechanical switch may be incorporated in connector 144 by providing an insulated contact carrier journaled to slide within connector 144 and able to carry switching contacts to make or break electrical connection between each pin 146 and corresponding contact 156.

Although the present invention is described and illustrated with detailed reference to the preferred embodiment, the invention is not intended to be limited to the details of such embodiment but includes numerous modifications and changes thereto while still falling within the intent and spirit hereof.

I claim:

1. A bridging connector for electrically connecting a plurality of wire-wrap posts on a first jack to a like number of pin contactors on a second jack, comprising:

(a) a nonconductive body having a non-conductive post separator housing, the housing comprising two housing walls and a blade member and a plurality of tooth members disposed between the housing walls;

(b) a plurality of contacts disposed in the body for contact with the posts on the first jack; and (c) a plurality of pins electrically connected to the contacts and disposed in the body to be engaged by the contactors in the second jack.

2. A connector according to claim 1, wherein said contacts are bifurcated bellow spring contacts of phosphor bronze with gold plating over nickel and said pins are square in cross-section.

3. A connector according to claim 2, further comprising a pin block attached to said body having pin holes in which said pins are disposed.

4. A bridging insulator for physically mounting a jack having two bores and a plurality of wire-wrap posts to a second like jack comprising:

(a) a nonconductive body having a non-conductive post separator housing, the housing comprising two housing walls and a blade member and a plurality of tooth members disposed between the housing walls;

(b) a means attached to the insulator for securing the insulator to the first jack; and (c) at least one stud attached to the body to be received in one of the bores.

5. An insulator according to claim 4, wherein said securing means is at least one rotatable clamp.

* * * * *